United States Patent [19]

Hayes

[11] Patent Number: 4,463,519

[45] Date of Patent: Aug. 7, 1984

[54] REVERSIBLE DIRECTION DRIVE MECHANISM FOR TOY VEHICLES

[75] Inventor: Thomas J. Hayes, New York, N.Y.

[73] Assignee: Buddy L Corporation, New York, N.Y.

[21] Appl. No.: 360,915

[22] Filed: Mar. 23, 1982

[51] Int. Cl.[3] ..... A63H 17/40

[52] U.S. Cl. ..... 446/443

[58] Field of Search ..... 46/206, 207, 208, 209, 46/212, 213, 211, 201, 202, 219

[56] References Cited

U.S. PATENT DOCUMENTS

| | | | |
|---|---|---|---|
| 2,035,870 | 3/1936 | Dombrowski | 46/206 X |
| 2,172,416 | 9/1939 | Swenson | 46/213 |
| 2,618,101 | 11/1952 | Berger | 46/212 |
| 2,971,289 | 2/1961 | Reed et al. | 46/206 X |
| 3,535,947 | 10/1970 | Kupperman et al. | 46/206 X |
| 3,775,902 | 12/1973 | Gagnon | 46/213 X |

*Primary Examiner*—Mickey Yu

*Attorney, Agent, or Firm*—Kenyon & Kenyon

[57] ABSTRACT

An improved drive mechanism for a toy vehicle in which a pair of traction wheels are driven by a helical spring disposed coaxially about the wheel axle. The spring is connected at one end to the axle on which the traction wheels are mounted and at the other end to a housing for the axle and the spring which is rotatably mounted with respect to the vehicle body. The spring propels the vehicle after initial forward movement by the user substantially back to the point of release in an orientation opposite to that during initial forward movement of the vehicle.

7 Claims, 4 Drawing Figures

REVERSIBLE DIRECTION DRIVE MECHANISM FOR TOY VEHICLES

BACKGROUND OF THE INVENTION

1. Field of the Invention

The present invention relates generally to toy vehicles, and more particularly to drive mechanisms for inertia-type toy vehicles such as cars, trucks, and the like, which are initially propelled by the user and are then returned substantially back to the point of release under their own power by utilizing energy stored in a resilient member such as a rubber band or spring.

2. Description of the Prior Art

Several resilient type driving mechanisms for toy vehicles for known. For example, U.S. Pat. Nos. 3,645,039, 3,601,924 and 3,611,631 disclose vehicles propelled by energy stored in a rubber band. These particular drive mechanisms, however, do not allow the toy to reverse direction and return to the point of release. Another patent, U.S. Pat. No. 4,241,534, discloses a driving mechanism using a spiral spring which is wound by pushing the toy vehicle in the reverse direction, and then releasing the toy so that the spring unwinds, driving the vehicle in the forward direction only.

U.S. Pat. No. 2,830,403 discloses a toy vehicle which utilizes a spiral spring connected to a cord which wraps around a shaft provided with a tapered sleeve. When the toy vehicle is pushed in the forward direction, the cable wraps around the tapered sleeve and winds the spiral spring. Upon reaching the limit of travel, the spring unwinds, unwrapping the cord and allowing the vehicle to return to the user. This system utilizes a relatively complicated arrangement to transfer the energy stored in the springs to the driven axle, and the toy is capable of moving only in a straight line without changing orientation.

Another U.S. Pat. No. 3,756,333 describes a toy vehicle utilizing a helical spring coaxial with the driven axle. The toy vehicle disclosed in this patent, however, is again movable only in a straight line in the forward and reverse directions and cannot change its direction of orientation.

SUMMARY OF THE INVENTION

It is an object of the present invention to provide a toy vehicle containing a simple mechanism for winding up a spring or other resilient energy storing member when the toy is pushed in one direction, and, when the spring is completely wound, allows the spring to unwind and propel the toy in the opposite direction back to the user.

It is a further object of the invention to provide a toy vehicle of the type described which can also travel forward and return to the user along substantially the same travel path but in an orientation opposite to that during initial movement of the vehicle.

These and other objects of the present invention are achieved in a toy vehicle including a body and a plurality of wheels rotatably mounted on the body. At least two of the wheels are traction wheels for propelling the vehicle in a predetermined direction and are mounted on horizontal axle means and adapted for rotation therewith. The improvement comprises drive means for the traction wheels including spring means disposed in housing means, the housing means disposed about and surrounding at least part of the axle means and the spring means, the housing means being mounted on the body so that the body is rotatable with respect thereto about an axis perpendicular to the longitudinal axis of the axle means. One end of the spring means is coupled to the housing means and the other end of the spring means is coupled to the axle means, whereby the vehicle is propelled by the spring means after initial movement by the user substantially back to the point of release in an orientation opposite to that during the initial movement by a user.

These and other novel features and advantages of the invention will be described in greater detail in the following detailed description.

DETAILED DESCRIPTION

Figure 1:
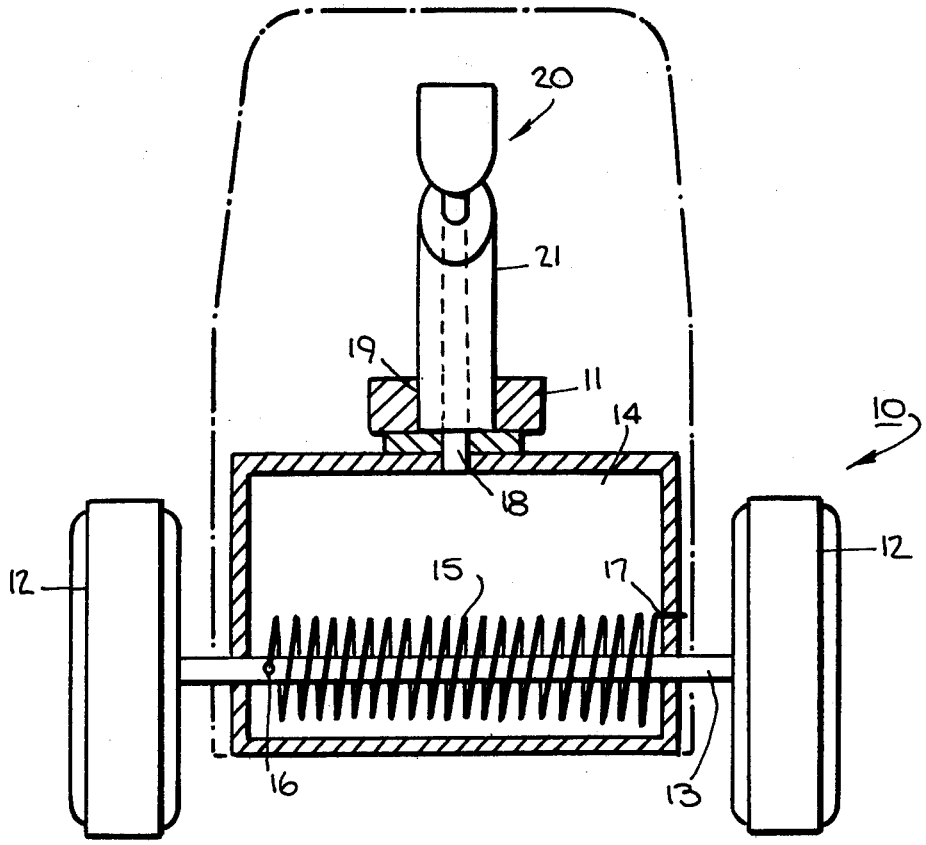
FIG. 1 is a cross-sectional view of one embodiment of an improved drive mechanism for toy vehicles constructed according to the present invention illustrating the position of the drive mechanism, viewed looking toward the front of the vehicle, when the traction wheels are disposed in the engagement with the ground.
Figure 2:
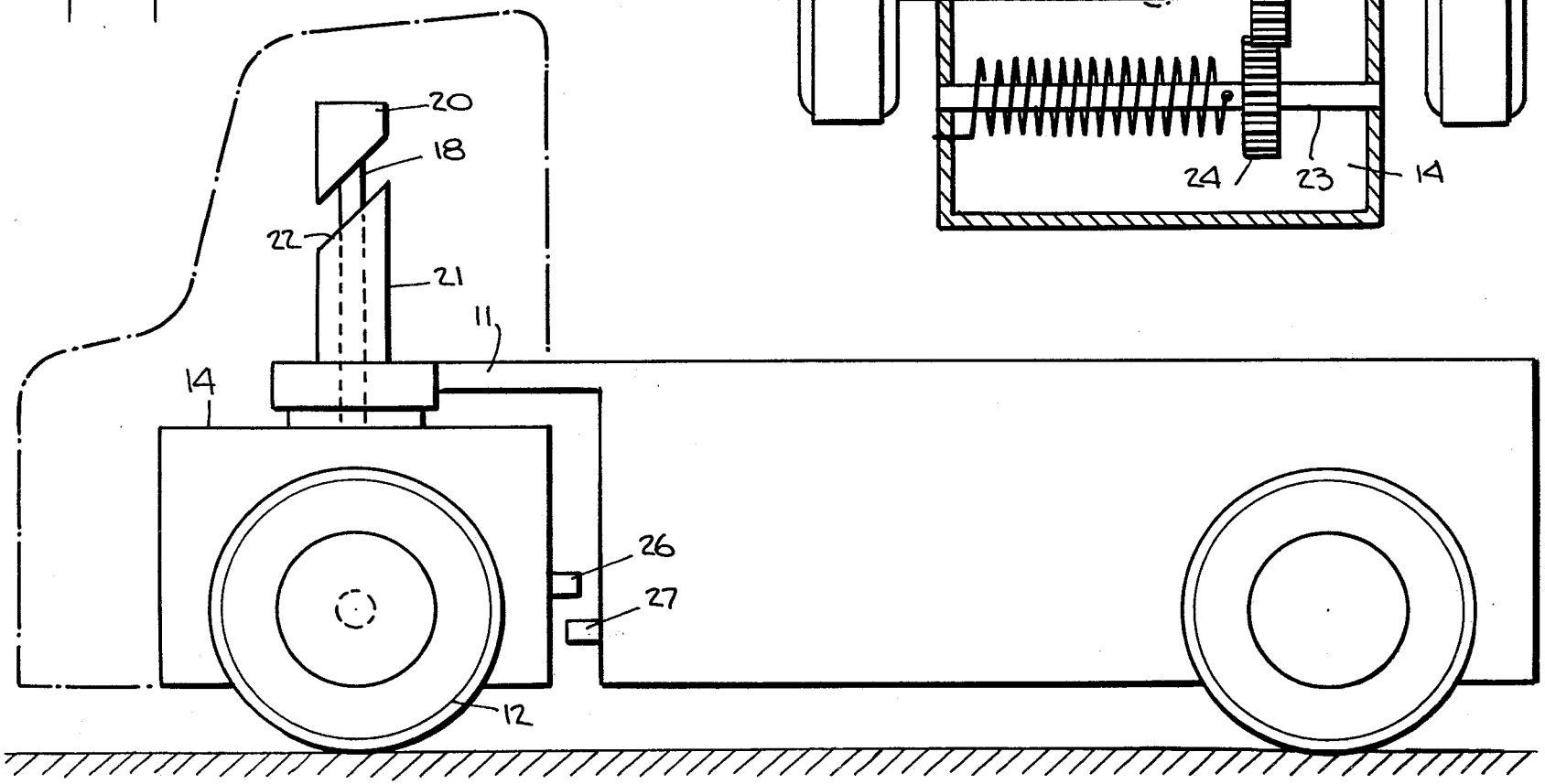
FIG. 2 is a side view of the improved drive mechanism of FIG. 1, again showing the position of the mechanism when the traction wheels are in engagement with the ground.

Referring now to the drawings, and in particular to FIGS. 1 and 2, there is shown a drive mechanism for a toy vehicle, generally identified by reference numeral 10, including a body 11 (part of which is schematically illustrated in the drawing), and a plurality of traction wheels 12 which, in the illustrated embodiment of the invention, comprise the front wheels of the vehicle, rotatably mounted on the body for propelling the vehicle in a predetermined direction. Wheels 12 are mounted on a horizontally-disposed axle 13 and are affixed to the end thereof so as to be rotatable therewith. A rectangular-shaped housing 14 is disposed about and surrounds at least part of axle 13. A suitable spring, such as helical spring 15, is disposed coaxially about axle 13 within housing 14 and has one end 16 coupled directly to axle 13 and the other end 17 coupled to the interior surface of housing 14. Housing 14 is coupled to a vertical axle 18 which passes through an aperture 19 surrounded by a tube 21 integrally formed with the vehicle body 11 and is connected to a mounting member 20 disposed within the interior of the vehicle body which is slidably disposed on the top edge 22 of tube 21 when traction wheels 12 are lifted from the ground. Member 20, as can be readily seen in FIG. 2, has a profile in the shape of a trapezoid as a result of the lower edge of the member being downwardly inclined towards the front end of the housing 14. The upper edge 22 of tube 21 is also downwardly inclined towards the front end of the vehicle body 11. As a result, housing 14 is freely rotatable through an angle of 360° with respect to vehicle body 11, and vice versa, when the traction wheels are disposed in engagement with the ground (as shown in FIGS. 1 and 2). When the traction wheels are lifted from the ground, the mounting member 20 automatically turns itself, and axle 18, and housing 14, so that the front end of the housing faces the front end of the vehicle body. Stop members such as abutments 26 and 27 mounted on housing 14 and vehicle body 11, respectively, which are in horizontal alignment and engage when the traction wheels are lifted from the ground may be utilized to stop rotational movement of the housing during orientation of the front end of housing 14 by member 20.

Figure 3:
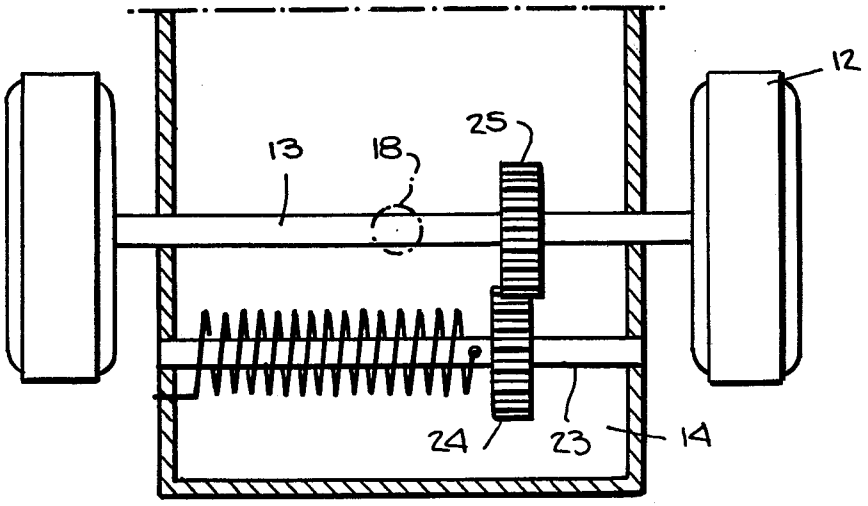
FIG. 3 is a top view of another embodiment of an improved drive mechanism constructed according to the present invention.

FIG. 3 illustrates an alternate embodiment of the drive mechanism in which a second horizontal axle 23 is rotatably mounted in housing 14 and is coupled to first horizontal axle 13 by means of intermeshing gears 24 and 25 fixed to axles 23 and 13, respectively.

In operation, the vehicle is propelled forward by the user and as the vehicle moves, spring 15 winds and tightens itself around horizontal axle 13. When the spring is fully wound tightly around the axle, the vehicle stops and wheels 12 reverse direction, propelling housing 14 backward as the spring unwinds. As the housing is propelled backward, the vehicle body turns about axle 18 until it is disposed in an orientation which is the reverse of that in which the vehicle was initially disposed when propelled forward by the user. The vehicle then travels back to the user.

The traction wheels 12 and housing 14 remain in the same orientation during both forward and reverse movement of the vehicle away from and back to the user. Suitable means to limit the rotational movement of the vehicle body 11 with respect to housing 14 and traction wheels 12, for example, engageable abutments, may be disposed on the surface of housing 14 and vehicle body 11, respectively, if desired. Such abutments can be used to limit the turning of the vehicle body to an angle of, for example, approximately 180° with respect to housing 14, and permit the rear portion of the vehicle body to turn in only one direction. The body of the vehicle may, in addition to such abutments also include an elongated slot on one side, instead of a circular aperture, through which the axle for the rear wheels of the vehicle may pass to assure turning of the vehicle body during reverse movement of the traction wheels. Extra weight can also be added to the forward portion of housing 14 or body 11 to prevent rotation of the housing 14 during forward movement of the vehicle and to assure sufficient momentum of the vehicle during forward movement to wind spring 15 tightly about axle 13. It also should be noted that other suitable means, such as a spring, may be used instead of member 20 to orient the front end of the housing so that it faces the front end of the vehicle when the traction wheels are lifted from the ground.

Figure 4:
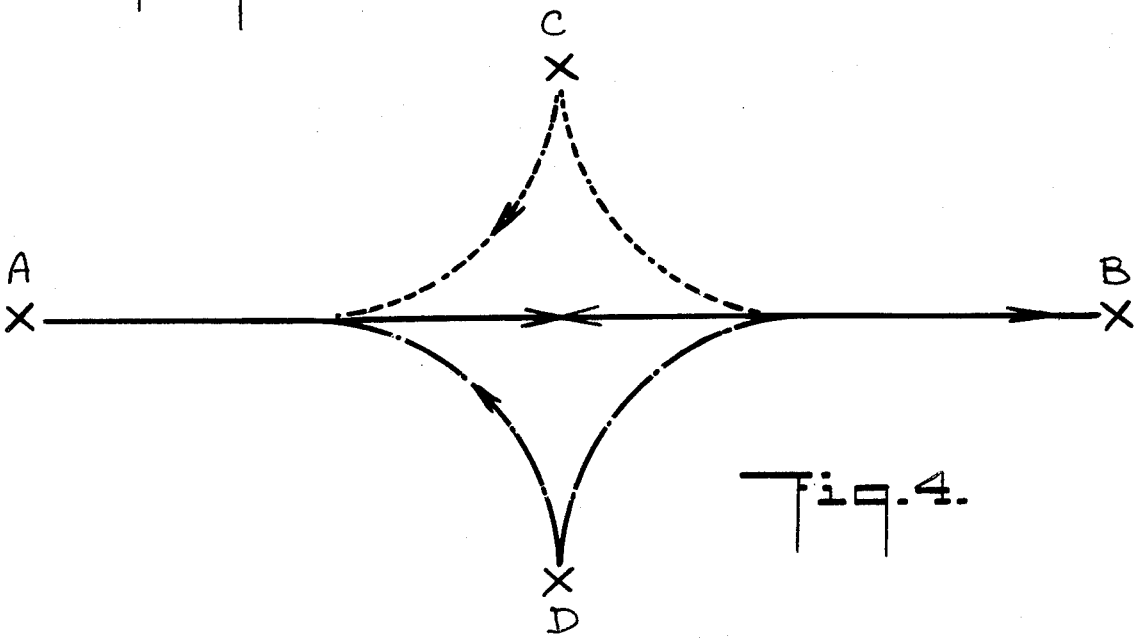
FIG. 4 is a graphical illustration of the travel path of the rear wheels and rear portion of the body of a vehicle propelled by the improved drive mechanism of the present invention.

Referring to FIG. 4, when the vehicle is propelled forward by the user, it travels in a straight line from its initial starting point A to point B, where spring 15 stops the motion of the housing 14 and traction wheels 12 and propels the housing in a reverse direction back to the user. As the vehicle body moves backward, housing 14 retains its original orientation, but the rear wheels and rear portion of the body of the vehicle turn as vehicle body 11 pivots about axle 18 and swing outwardly in a circular arc to either point C or D. When the traction wheels 12 pass either of these points in their movement back toward point A, the rear wheels and rear portion of the vehicle body stop moving backward and being moving forward along a circular arc toward point A. The vehicle body thus reverses its orientation as the drive mechanism propels the vehicle back to the user, i.e., the front end of the vehicle faces away from the user as it is initially propelled forward, and faces the user as it travels back. During the entire time the vehicle travels away from and back to the user, the traction wheels 12 and housing 14 retain the same orientation. When the vehicle returns to the user, the vehicle is lifted so that the mounting member 20 can reorient housing 14 so that its front end faces the front of the vehicle body, whereupon the vehicle is again ready for forward movement away from the user.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a toy vehicle including a body, a plurality of wheels rotatably mounted on said body, at least two of said wheels being traction wheels for propelling the vehicle in a predetermined direction and being mounted on horizontal axle means and adapted for rotation therewith, an improved drive means for said traction wheels, comprising, spring means coupled to said axle means, housing means disposed about and surrounding at least part of said axle means and said spring means, said housing means being mounted on said vehicle body so that said body is rotatable with respect thereto about an axis perpendicular to the longitudinal axis of said axle means, one end of said spring means being coupled to said housing means and the other end of said spring means being coupled to said axle means, said spring means being wound during initial movement by a user until said vehicle body comes momentarily to rest, said spring means thereafter propelling said vehicle body on a return movement in a direction back to the user, said vehicle body rotating about said housing means during said return movement so that said vehicle body returns substantially back to the point of release in an orientation opposite to that during said initial movement by the user, said housing means maintaining a substantially fixed orientation during said initial and return movements.

2. The improvement recited in claim 1, further comprising, vertical axle means coupled to said housing means and disposed perpendicular to said horizontal axle means, mounting means slidably disposed within said vehicle body above said housing means and rotatable with respect thereto, said mounting means being coupled to said vertical axle means for permitting rotational movement of said vehicle body with respect to said traction wheels, housing means, and said spring means.

3. The improvement recited in claim 2, wherein said housing means includes aperture means disposed at the longitudinal ends thereof, said horizontal axle means being disposed through said aperture means so as to be disposed at least partially within said housing means.

4. The improvement recited in claim 3, wherein said one end of said spring means is coupled to an interior surface of said housing means, and wherein said other end of said spring means is coupled to said axle means within the interior of said housing means.

5. The improvement recited in claim 4, wherein said housing means includes a front end and a back end, and wherein said mounting means includes means for orienting said front end of said housing means with respect to the front end of said vehicle body when said traction wheels are lifted from the ground.

6. The improvement recited in claim 5, wherein said horizontal axle means is coupled to said spring means by gear means.

7. The improvement recited in claim 1, wherein said spring means is disposed coaxially about said axle means.

* * * * *